US006688504B1

(12) United States Patent
Kirkaldy

(10) Patent No.: US 6,688,504 B1
(45) Date of Patent: Feb. 10, 2004

(54) SPEEDLOADER DISPENSER

(76) Inventor: Robert Kirkaldy, P.O. Box 1272, Healdsburg, CA (US) 95448

( * ) Notice: Subject to any disclaimer, the term of this patent is extended or adjusted under 35 U.S.C. 154(b) by 111 days.

(21) Appl. No.: 10/122,923

(22) Filed: Apr. 12, 2002

(51) Int. Cl.[7] ..... F42B 39/26

(52) U.S. Cl. ..... 224/196; 42/89; 224/251; 224/931

(58) Field of Search ..... 224/196, 245, 224/251, 269, 931; 221/185; 42/89

(56) References Cited

U.S. PATENT DOCUMENTS

| | | | | | |
|---|---|---|---|---|---|
| 201,855 | A | | 3/1878 | White | |
| 202,613 | A | | 4/1878 | White | |
| 354,454 | A | | 12/1886 | Wesson | |
| 1,228,505 | A | | 6/1917 | Wesson | |
| 2,399,904 | A | * | 5/1946 | Baucum | 24/89 |
| 2,756,913 | A | * | 7/1956 | Oswald | 224/196 |
| 3,219,244 | A | * | 11/1965 | Blask | 221/185 |
| 3,769,733 | A | * | 11/1973 | Nelson | 42/89 |
| 4,180,192 | A | * | 12/1979 | Breslau | 224/196 |
| 4,408,707 | A | | 10/1983 | Rogers | |
| 4,583,659 | A | * | 4/1986 | Carter | 224/931 |
| 4,685,600 | A | * | 8/1987 | Reuschel | 224/196 |
| D322,833 | S | | 12/1991 | Martin | |
| 5,548,916 | A | | 8/1996 | Kinsel et al. | |
| 6,000,589 | A | * | 12/1999 | Burdine | 224/931 |

* cited by examiner

*Primary Examiner*—Gary E. Elkins

(57) ABSTRACT

A device for dispensing reload cartridge packs for use with a revolver style firearm that can dispense a cartridge pack upon the activation of a dispensing control mechanism. The device is mountable on an article of the user's clothing, such as a belt or harness. The device includes a body defining an interior compartment for storing a number of reloading cartridge packs. A dispensing actuator is mounted on the body for triggering the release of one of the reloading cartridge packs. A mechanism mounted on the body is provided for retaining the reloading cartridge packs in the interior compartment and releasing one of the reloading cartridge packs from the interior compartment upon activation of the dispensing actuator. The dispensing orifice and the actuator optimize the speed and ease of use of the device for use in reloading a revolver.

20 Claims, 4 Drawing Sheets

SPEEDLOADER DISPENSER

BACKGROUND OF THE INVENTION

1. Field of the Invention

The present invention relates to an ammunition carrier and method to dispense ammunition in a manner that provides quick and easy reloading of a revolver type firearms.

2. Description of the Prior Art

The need for a method to quickly reload a firearm with a revolving cylinder magazine has been made known in the prior art. U.S. Pat. Nos. 201,855, 202,613, and 5,548,916 all teach methods in which multiple fire arm cartridges are stored in a carrier designed to reload a revolving cylinder magazine. These methods generally describe a series of connected tubes that hold groups of individual cartridges in a configuration so that when the carrier is mated with a revolving magazine cylinder the individual cartages are released therein.

Also known are methods of carrying reloading cartridge packs as taught by U.S. Pat. Nos. 354,454 and 4,408,707, which demonstrate carrying individual reloading cartridge packs on a belt for easy access when reloading.

While these devices fulfill their respective, particular objectives and requirements, the need remains for a device that further advances the methods afore described by providing a single dispenser that carries multiple reloading cartridge packs so that a firearm user can instinctively reach for the same container to dispense cartridge packs each time a cartridge pack is needed.

SUMMARY OF THE INVENTION

It is therefore an objective of this invention to provide a device that carries multiple reloading cartridge packs for a revolver which can be carried on a user's belt, harness or holster which will dispense a single reloading cartridge pack by the activation of a control actuator.

In general, the invention includes a body defining an interior compartment for storing a number of reloading cartridge packs. A dispensing actuator is mounted on the body for triggering the release of one of the reloading cartridge packs. A mechanism mounted on the body is provided for retaining the reloading cartridge packs in the interior compartment and releasing one of the reloading cartridge packs from the interior compartment upon activation of the dispensing actuator.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty, which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
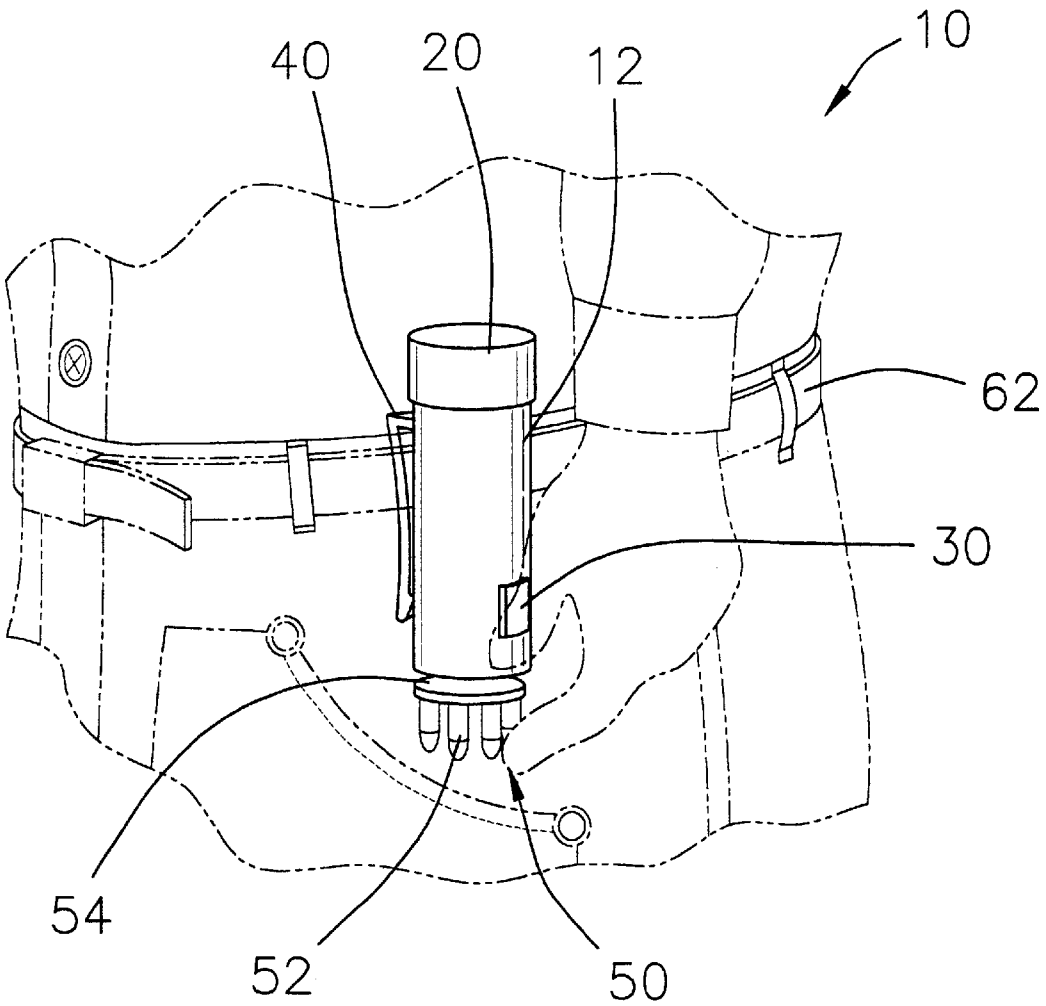
FIG. 1 is a schematic illustration of a manner in which the reloading cartridge pack is removed from the invention while the invention is attached to the user's belt.
Figure 2:
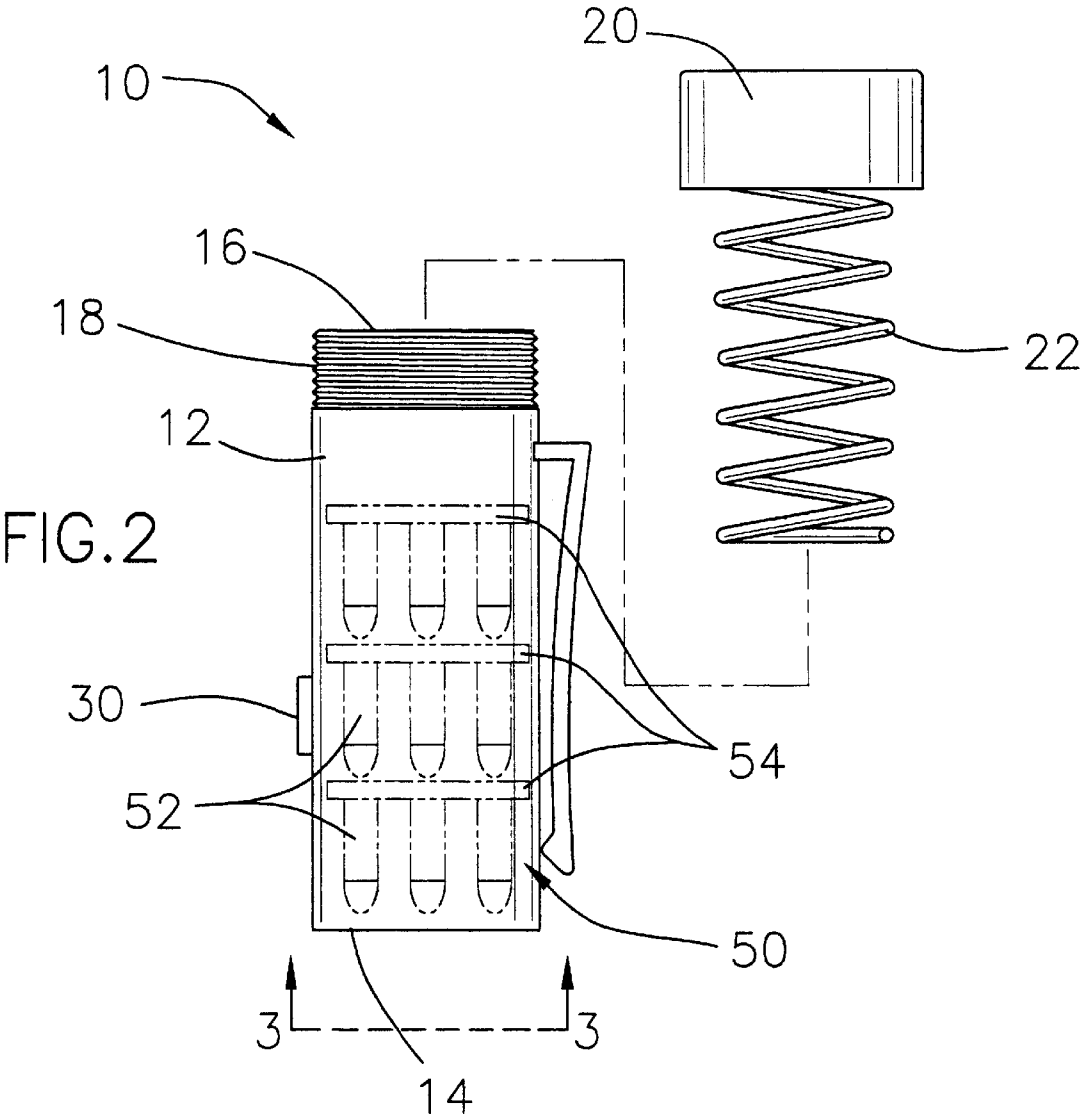
FIG. 2 is an exploded view of the present invention showing the retaining cap removed and the main spring visible. Also shown is the schematic of how the reloading cartridge packs would fit in the interior of the body.
Figure 3:
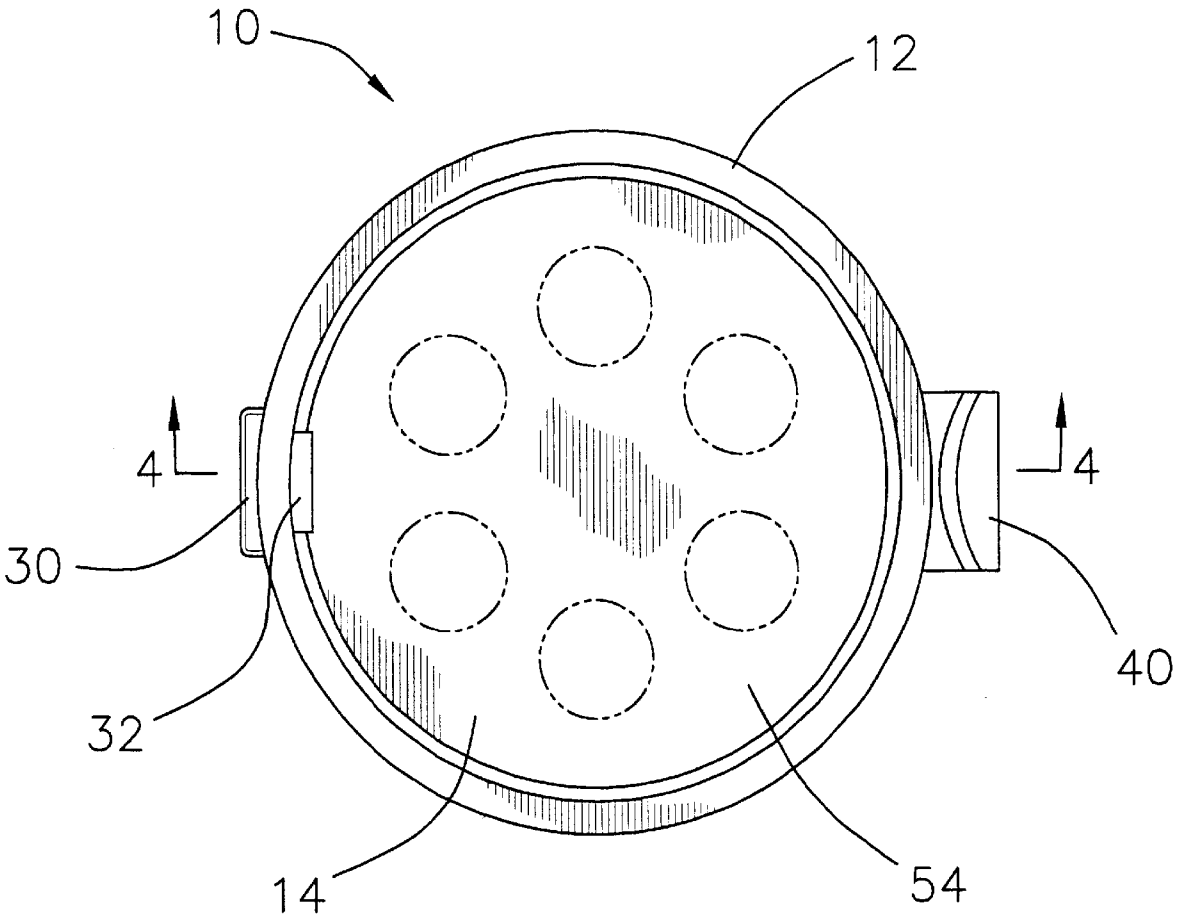
FIG. 3 is a view of the present invention viewing into the dispenser orifice.
Figure 4:
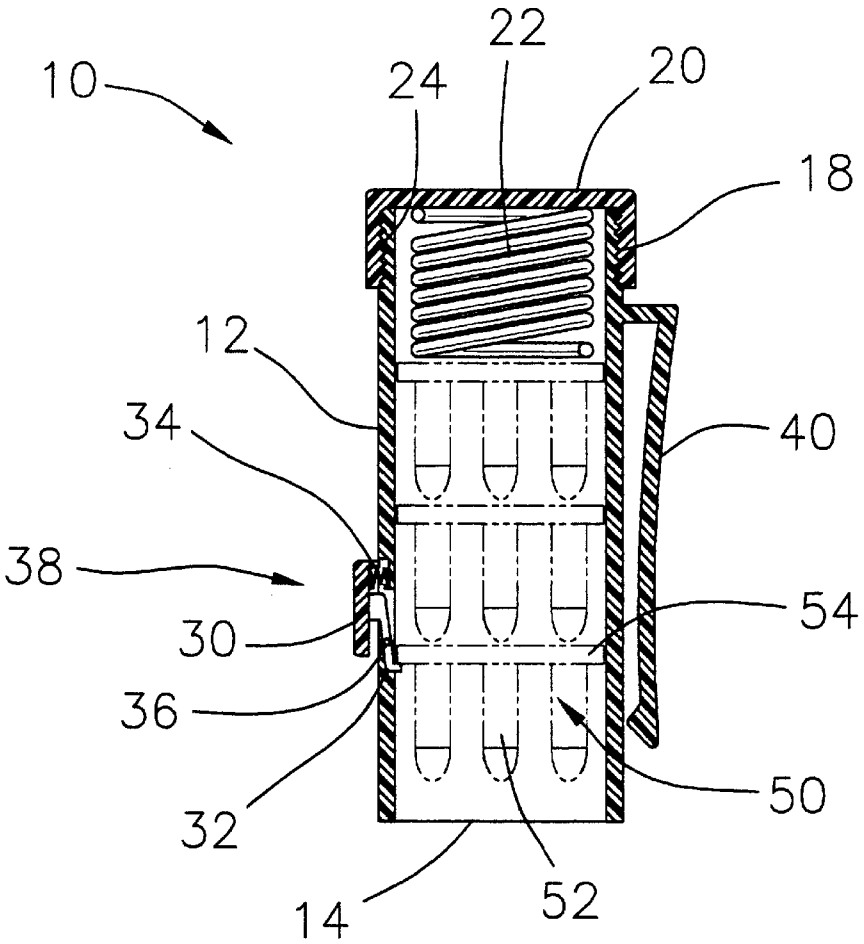
FIG. 4 is a cross section view of the present invention with representation of multiple reloading cartridge packs.

With reference now to the drawings, and in particular to FIGS. 1 through 4 thereof, a new speedloader dispenser reloading device embodying the principles and concepts of the present invention and generally designated by the reference numeral 10 will be described.

As best illustrated in FIGS. 1 through 4, the speedloader dispenser 10 generally comprises a cylindrical body 12 conforming to the general shape of revolver reloading cartridge packs 50. The body may be designed to a length and diameter to accommodate a quantity of reloading cartridge packs 50. The dimensions would be defined by the caliber, ammunition type, and the number of reloading cartridge packs 50 the speedloader dispenser was intended to hold.

The reloading cartridge pack 50 comprises a cartridge retaining jig 54 that would hold secure a number of cartridges 52 in a group and in positions identical to those, which they assume when placed in the magazine cylinder of a revolver type firearm.

The body would possess two ends. One of which may be a dispensing orifice 14 and the other the cap orifice 16. The cap orifice 16 end of the body 12 may include a body coupling apparatus 18 that would couple to the retaining cap 20 with a correferred to herein as the cap coupling apparatus 24.

The coupling mechanisms 18 and 24 depicted in the illustrations each comprise a pair of mated screw threads although the invention is not so limited. For example, the coupling means may also be a rotary positive pressure latch as is known in child proof caps for medicine bottles, or a mating friction collar as is know in plastic container lids.

Mounted in the retaining cap 20 is the main spring 24 which may be included to provide a spring bias against the reloading cartridge packs 50 for pressing against the reloading cartridge packs 50 located within the body in a direction toward the dispensing orifice 14.

Located on the exterior of the body 12 there may be a dispensing actuator 30. The dispensing actuator would function as the control device for dispensing a reloading cartridge pack 50. The dispensing actuator may be mechanically coupled to the release latch 32 which would hold the reloading cartridge packs 50 by engaging the cartridge retaining jig 54 in one or more locations in the interior of the body 12.

The dispensing mechanisms 38 may be include the dispensing actuator 30 that would be in contact with one end of the release latch 32 and retained by a fulcrum 36 so that the end of the release latch 32 engages the cartridge retaining jig 54 of the reloading cartridge pack 50, and would disengage from the cartridge retaining jig 54 when the dispensing actuator 30 was depressed. The dispensing actuator 30 and the release latch are held in the position to engage the cartridge retaining jig 54 by a release latch spring 34.

Although illustrations of the dispensing mechanism conform to the description given above the invention is not so limited. Variations on the different elements and their interactions within the mechanism have been anticipated. For example there may be multiple release latches 32 located within the body 12 to engage the reloading cartridge pack 50 closest to the dispensing orifice 14 or multiple release latches 32 located within the body 12 to engage multiple reloading cartridge packs 50 located within the body 12. Also anticipated would be the use of alternatives to the release latch spring such as leaf spring devices, self-reformable foam material, elastomer dome constructions, etc. The dispensing actuator may take the form of a button, slider, handle, ring, knob, etc. The dispensing actuator may also include a safety device or method to prevent unintended actuation of the mechanism such as a redundant action method. For example, the mechanism may require pressing the actuator down while sliding it forward or press the actuator down and then twisting clockwise. The dispensing mechanism is also not limited to a mechanical method as electronically controlled release mechanisms are well known. For example magnetic locks, solenoids and motor actuated release methods could be employed alternatively to mechanical methods. An electronic actuator may conceivably be remote to the unit relying on radio, sonic or light broadcast signals for activating the dispensing mechanism 38. The accompanying illustrations are meant to teach a simple embodiment exemplary of the rudimentary function of the invention without undue explanation of alternative methods available when reducing the invention to practice.

A mounting apparatus 40 may be located on the exterior of the speedloader dispenser 10. The mounting apparatus 40 in the illustrations depicts a spring clip forming a loop, which can be quickly mounted on a belt 62, or harness. Although the invention is not so limited. For example, the illustration depicts a spring clip that is formed as part of the body 12 but the spring clip could be comprised of a separate piece that would be permanently or removably mounted to the exterior of the body 12. The mounting apparatus may take the form of a closed loop comprised of hard plastic, nylon, leather or other material or take the form of two flexible members that connect to each other to form a loop using snaps and grommets, eye hooks, hook and loop fasteners, knots or other means to couple the two ends.

In use, a speedload dispenser 10 would be mounted on the user by the mounting apparatus 40 in a location where the user could access the device quickly and easily. The speedload dispensers 10 would be loaded with a number of reloading cartridge packs 50 by removing the retaining cap 20 from the body 12 by disengaging the cap coupling apparatus 24 from the body coupling apparatus 18 and placing a number of reloading cartridge packs 50 into the cap orifice 16 with the cartridge 52 side of the reloading cartridge pack 50 directed to the dispensing orifice 14 of the body 12. The retaining cap 20 would then be re-coupled to the body by inserting the main spring 22 end of the retaining cap into the cap orifice 16, compressing the main spring 22, and reengaging the cap coupling apparatus 24 to the body coupling apparatus 18.

An alternative to the reloading method described above would be the elimination of the removability of the retaining cap 20 by substituting a permanent cap formed with the body 12. The loading method may then comprise inserting the reloading cartridge packs 50 into the body 12 through the dispensing orifice 14 in a manner exactly contrary to the method of dispensing as described below.

The user could carry the reloading cartridge packs 50 in the speedloader dispenser 10 until needed. When the user desired to reload an emptied revolver cylinder the user would activate the dispensing actuator 30, which would compress the release latch spring 34. The mechanically communicated motion of the release latch 32 turning around the fulcrum 36 the release latch 32 would disengage the cartridge retaining jig 54 of the reloading cartridge pack 50 which was closest to the dispensing orifice 14. The released reloading cartridge pack 50 would exit the dispensing orifice 14 propelled by the bias of the main spring 22 communicated directly on or by way of mechanical communication through the remaining reloading cartridge packs 50.

Alternatively, the device may rely on gravity to propel the released reloading cartridge pack out of the dispensing orifice and to advance the remaining reloading cartridge pack/s toward the release latch.

In FIG. 1, the dispensing actuator 30 is located on a portion of the exterior of the body 12 so that the user can activate the dispensing actuator 30 with the thumb so that the reloading cartridge pack is propelled into the user's awaiting fingers. Other configurations of dispensing actuator placement in reference to the trajectory of the reloading cartridge pack are anticipated. For example, the speedloader dispenser could be mounted on the user in an orientation opposite from FIG. 1 with the dispensing orifice pointing upwards. The dispensing actuator may be embodied in a ring configuration on the rim of the dispensing orifice so that the user could activate the dispensing actuator 30 with the lower palm of the hand and the reloading cartridge pack 50 would be projected into the user's palm.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device for dispensing reloading cartridge packs comprising:

a body defining an interior compartment for storing a number of reloading cartridge packs;

a dispensing actuator mounted on the body for triggering the release of one of the reloading cartridge packs; and a mechanism mounted on the body for retaining the reloading cartridge packs in the interior compartment and releasing one of the reloading cartridge packs from the interior compartment upon activation of the dispensing actuator.

2. The device of claim 1 wherein the means for propelling the reloading cartridge pack from the interior compartment comprises a spring.

3. The device of claim 1 wherein the means for propelling the reloading cartridge pack from the interior compartment comprises gravity.

4. The device of claim 1 wherein the reloading cartridge packs are loadable into the interior compartment and dispensable out of the interior compartment through a same orifice.

5. The device of claim 1 including a loading orifice through which the reloading cartridge packs are loaded into the interior compartment and a dispensing orifice through which the reloading packs are dispensed from the interior compartment, the loading orifice and the discharging orifice being distinct orifices.

6. The device of claim 5 wherein the loading orifice is closed with a retaining cap.

7. The device of claim 6 wherein the retaining cap includes a spring for ejecting the cartridge packs from the interior compartment.

8. The device of claim 1 wherein the dispensing actuator comprises a mechanical apparatus.

9. The device of claim 1 wherein the dispensing actuator comprises an electrical apparatus.

10. The device of claim 1 additionally comprising a mounting apparatus for mounting the device on a user.

11. The device of claim 9 wherein the mounting apparatus clips onto a user's belt.

12. The device of claim 9 wherein the mounting apparatus forms a portion of the body.

13. The device of claim 11 wherein the mounting apparatus comprises a spring clip forming a loop.

14. A device for dispensing reloading cartridge packs comprising:

a tubular shaped body forming an interior compartment for storing a number of reloading cartridge packs;

said tubular body having at least one end opening forming an orifice;

a dispensing actuator located on an exterior of the body for triggering release of a reloading cartridge pack from the interior compartment; and a mechanism for retaining the reloading cartridge packs in the interior compartment and releasing a reloading cartridge pack from the interior compartment upon activation of the dispensing actuator.

15. The device of claim 14 additionally comprising mounting means for mounting the body on a user's attire.

16. The device of claim 14 wherein the dispensing actuator comprises a mechanical apparatus.

17. The device of claim 14 wherein the dispensing actuator comprises an electrical apparatus.

18. The device of claim 14 wherein a second orifice is located on an end of the tubular body opposite of the orifice.

19. The device of claim 18 additionally comprising a removable cap for closing the second orifice.

20. A device for dispensing reloading cartridge packs comprising:

a tubular shaped body forming an interior compartment for storing a number of reloading cartridge packs;

said tubular body having at least one end opening forming a first orifice, and a second orifice being located on an end of the tubular body opposite of the first orifice;

a dispensing actuator located on an exterior of the body for triggering release of a reloading cartridge pack from the interior compartment;

a mechanism for retaining the reloading cartridge packs in the interior compartment and releasing a reloading cartridge pack from the interior compartment upon activation of the dispensing actuator;

mounting means for mounting the body on a user's attire;

wherein the dispensing actuator comprises a mechanical apparatus; and a removable cap for closing the second orifice.

* * * * *